US007377855B2

(12) United States Patent
Pia

(10) Patent No.: US 7,377,855 B2
(45) Date of Patent: May 27, 2008

(54) SNAPPER ILLUSORY PUZZLE

(76) Inventor: Leroy Q. Pia, 1635 Yalecrest, Salt Lake City, UT (US) 84105

( * ) Notice: Subject to any disclaimer, the term of this patent is extended or adjusted under 35 U.S.C. 154(b) by 385 days.

(21) Appl. No.: 11/170,889

(22) Filed: Jun. 30, 2005

(65) Prior Publication Data

US 2007/0001401 A1 Jan. 4, 2007

(51) Int. Cl.
*A63G 31/00* (2006.01)
*A63G 31/16* (2006.01)

(52) U.S. Cl. ..... 472/71; 472/81

(58) Field of Classification Search ..... 472/51–57, 472/71, 81, 137
See application file for complete search history.

(56) References Cited

OTHER PUBLICATIONS

"Enchanted Snapper" from www.thetrickery.com, Aug. 3, 2004 (see attached www.web.archive.org).*

"Gospel Magic for Kids #2, Magic Snapper" from www.kidology.org, Jan. 12, 2005 (see attached www.web.archive.org).*

*Secret Solution*, POWCO International Ltd., New York, NY, (1983).

* cited by examiner

*Primary Examiner*—Kien T Nguyen
(74) *Attorney, Agent, or Firm*—Workman Nydegger; Wesley C. Rosander

(57) ABSTRACT

The present invention provides the illusion that an elastic apparatus is hooked from within a base unit, wherein actually hooking the elastic apparatus is virtually impossible. An opposite end of a rod is inserted at least partway into a hole of a base unit using the handle end of the rod. The base unit gives the appearance that the elastic device is attached to and extending within the hole thereof. The inserted opposite end of the rod is then pulled partially out of the base unit. But before the opposite end of the rod is exposed in viewable sight, two of a user's fingers are pressed together on substantially opposing sides of the handle end in order to forcibly snap the rod back into the base unit giving the illusion that the rod slipped from the user's fingers due to an opposing force from the elastic apparatus.

18 Claims, 3 Drawing Sheets

SNAPPER ILLUSORY PUZZLE

CROSS-REFERENCE TO RELATED APPLICATIONS

N/A

BACKGROUND OF THE INVENTION

1. The Field of the Invention

The present invention is generally related to puzzles, brain teasers, mind bogglers or benders, magic tricks, or the like. In particular, the present invention provides a device configured to give the illusion that a rubber band or other elastic apparatus is hooked or otherwise captured within a housing device, wherein the operation of hooking or catching the rubber band is virtually and/or conceptually impossible.

2. Background and Related Art

While the invention is subject to a wide range of applications, it is especially suited for use as a puzzle, brainteaser, mind boggler or bender, magic trick, or the like, and will be particularly described in these contexts. In the area of entertainment, there is always a need for new devices that the public might find intriguing. For example, magicians are always looking to find new tricks to add to their repertoire and/or people are continually entertained with new puzzles or mind boggling devices. For such novelty items, simple use and inexpensive manufacturing costs are always a concern.

Accordingly, it is an object of the present invention to provide an illusion device that is simple to use. Further, it is an object of the present invention to provide an illusion device that is inexpensive to manufacture.

BRIEF SUMMARY OF THE INVENTION

In order to meet the above-identified objectives, the present invention provides a method and device that give the illusion that a rubber band or other elastic apparatus is hooked from within a base unit using a rod, wherein actually hooking the elastic apparatus within the base unit is virtually and/or conceptually impossible.

For example, in a first example embodiment an opposite end of the rod is inserted at least partway into the hole of a base unit using the handle end of the rod. The base unit gives the appearance that the elastic device is attached to and extending within the hole thereof. The inserted opposite end of the rod is then pulled partially out of the base unit using a handle end of the rod. Next, before the opposite end of the rod is exposed in viewable sight, at least two of a user's fingers are pressed together on substantially opposing sides of the handle end of the rod in order to forcibly snap the rod back into the base unit giving the illusion that the rod slipped from the user's fingers due to an opposing force from the elastic apparatus pulling on the opposite end of the rod from within the base unit.

In another exemplary embodiment, a device for use in creating the illusion as if a rod has hooked an elastic apparatus from within a hole of a base unit is provided, wherein the actual hooking of the elastic apparatus within the base unit is virtually impossible. The device comprises an elongated base unit with a hole therein running substantially parallel to its length. Further, an elastic apparatus having the appearance that it extends at least partway into the hole of the base unit and is attached thereto is provided. Moreover, the device comprises a rod with a handle end and an opposite end. The handle end is used to insert the opposite end at least partway into the hole of the base unit and also used to partially extract the opposite end from the hole, wherein the handle end of the base unit is formed such that when a user's fingers apply pressure on substantially opposite ends thereof, the rod slips from the user's fingers and forcibly snaps into the base unit giving the illusion that the rod slipped from the user's fingers due to an opposing force from the elastic apparatus pulling on the opposite end of the rod from within the base unit.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
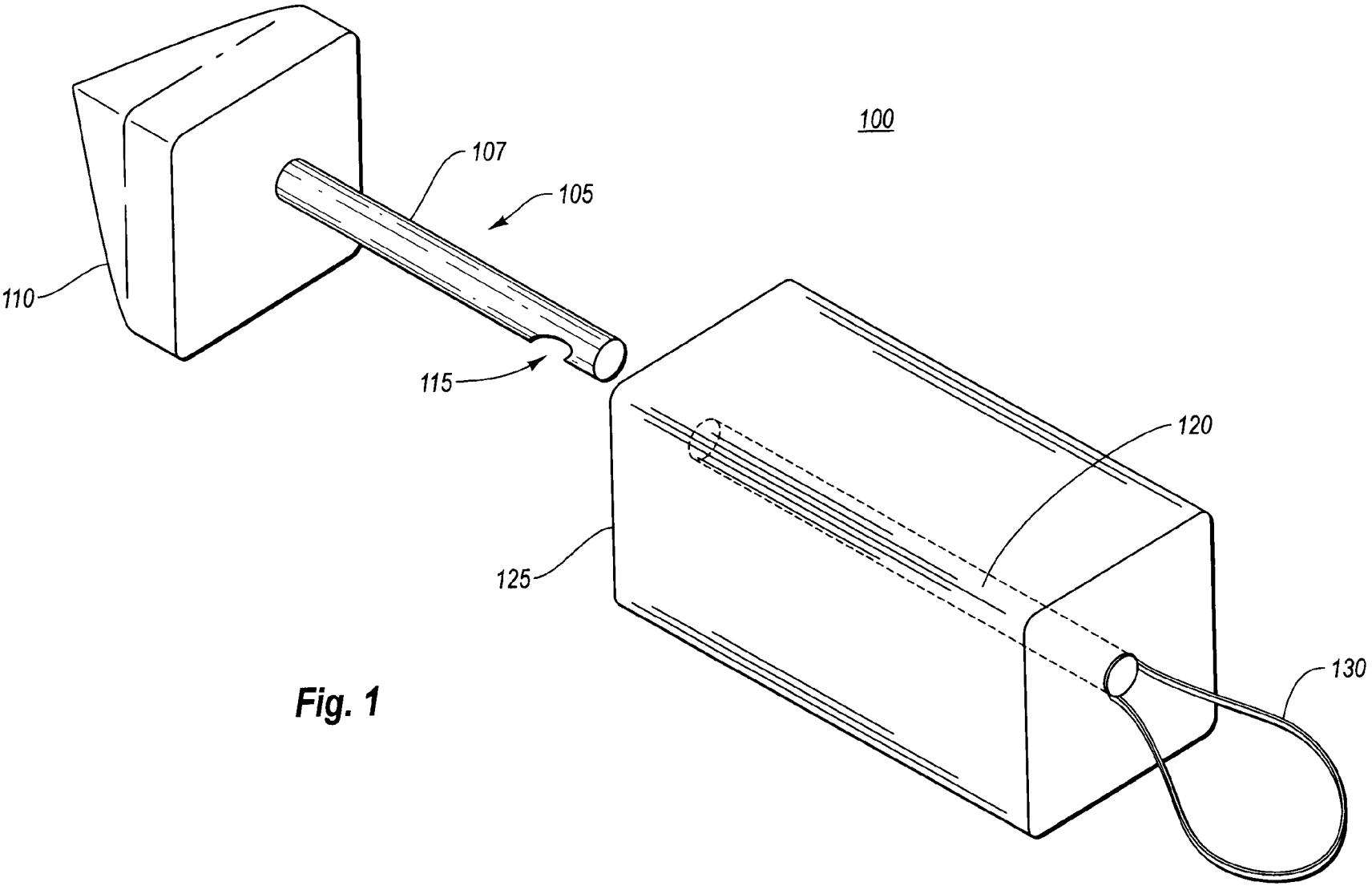
FIG. 1 illustrates an example illusory snap puzzle or device that can be used in accordance with exemplary embodiments of the present invention.

The present invention extends to methods and/or devices for creating the illusion as if a rod has hooked an elastic apparatus within the hole of a base unit, even though the hooking of the elastic apparatus is virtually and/or conceptually impossible. FIG. 1 illustrates an example of a puzzle or device 100 that may used to perform the above described illusion in accordance with exemplary embodiments of the present invention. The puzzle or device 100 includes a base unit 125 that has an elongated hole 120 running substantially parallel to the base unit's length. It should be noted, that although the present invention describes the base unit 125 as elongated and the relationship of the hole 120 in accordance therewith, the present invention is not restricted to any shape and/or relative size of the base unit 125 with relationship to the hole 120. For example, the base 125, rather than a rectangular block as shown in FIG. 1, may be a square cube with the hole 120 running substantially parallel along on of the sides. Accordingly, any specific shape and/or relative size of the base unit 125 in relationship to the hole 120 therein is used for illustrative purposes only and is not meant to limit or otherwise narrow the scope of the present invention unless explicitly claimed.

Regardless of the shape and/or relative size of the base unit 125 and the relationship of the hole 120 thereto, an elastic apparatus 130 is also provided that extends at least partway into the hole 120 of the base unit 125, as shown in FIG. 1. In this example, the material used to make the base unit is a nontransparent material such as wood, metal, ceramic, stone, fiberglass, or other similar nontransparent material. Accordingly, a portion of the elastic apparatus, e.g., a rubber band, should extending from the hole 120 outside of the base unit 125 in order to give the illusion that the elastic apparatus 130 extends within the hole 120 of base unit 125. Because in this example embodiment the inside of the hole 120 in the base unit 125 for nontransparent materials cannot be viewed by the naked eye, whether or not the elastic apparatus 130 actually extends fully within the hole 120 of the base unit 125 is not of critical concern. Accordingly, in this embodiment, it is sufficient to give the illusion as if the elastic apparatus 130 extends fully within the hole 120. In any event, as will be described in greater detail below, if the elastic apparatus 130 actually extends fully within the hole 120 of the base unit 125, the device 100 should be configured such that the elastic apparatus 130 cannot be hooked using the rod 105 of the puzzle or device 100 described below.

The rod 105 has a handle end 110 and an opposite or insertion end 115. The handle end 110 is used to insert the rod 105 (and in particular the opposite or insertion end 115) into hole 120 of the base unit 125. The opposing or insertion end 115 of the rod 105 will typically be formed in the shape of a hook. This enhances the illusion that the rod 105 is actually capable of hooking the elastic apparatus 130 within the base unit 125. Note, however, that the present invention is not limited to any specific shape or form of the opposite or insertion end 115. For example, the insertion end may be flat, for boggling or intriguing the mind even more as to how such a device could actually hook a rubber band or elastic apparatus 130. Accordingly, any specific shape of the opposite or insertion end 115 as described herein is used for illustrative purposes only and is not meant to limit or otherwise narrow the scope of the present invention unless explicitly claimed.

It should be noted that typically the diameter of the hole 120 will be just slightly larger than the diameter of the rod 105. The present invention, however, is not limited to any specific hole 120 diameter relative to shaft 107 and/or opposite end 115 of the rod 105 diameter. Further, the present invention is not limited in the shape of shaft 107 and/or hole 120 (e.g., the shape of the shaft 107 and/or hole 120 may be triangular); however, the shaft 107, opposite or insertion end 115, and/or hole 120 should be of such shape and/or relative sizes such that the shaft 107 of the rod 105 can be sufficiently inserted into the hole 120 of the base unit. An important aspect to note, however, is that regardless of the shape and/or sizes of the shaft 107, opposite or insertion end 115, and/or hole 120, any portion of the elastic apparatus 130 that extends within the base unit hole 120 should be virtually impossible to hook with the rod 105; otherwise the illusion described below no longer exists.

For example, if the elastic apparatus 130 fully extends into the hole 120 and the shaft 107 of the rod 105 is long enough such that the opposite or insertion end 115 of the rod 105 can come into actual contact with the elastic apparatus 130, the opposite or insertion end 115 of rod 105 should be large enough in diameter such that when inserted within the hole 120 of the base unit 125 the insertion end 115 pushes the elastic unit 130 down into the base unit 125. In other words, the diameter of the opposite or insertion end 115 should be sufficiently larger to ensure that the opposite or insertion end 115 is not actually capable of hooking the elastic unit 130, for this would frustrate the overall illusion.

Alternatively, if only a small or unsubstantial portion of the elastic apparatus 130 extends within the hole 120 of the base unit 125—and/or if the length of the shaft 107 is short in length—such that the opposite or insertion end 115 never comes into actual contact with the elastic apparatus 130—then the size of the opposite or insertion end 115 of the rod 105 and/or shaft 107 relative to the hole 120 should not make a significant difference in performing the illusion of the present invention. Accordingly, as one would recognize, there are a wide variety of shapes and/or sizes for the hole 120, the shaft 107 of the rod 105, the opposite or insertion end 115 of the rod 105, relative to each other.

Furthermore, the placement of the hole 120 and shaft 107 of the rod 105 relative to base unit 125 and handle 110, respectively, may also vary. In accordance with one embodiment, and as shown in FIG. 1, the hole 120 and shaft 107 of the rod 105 are off center of the base unit 125 and handle end 110, respectively. Accordingly, this has the added benefit of giving the illusion that a particular way of twisting the handle end 110, as described in greater detail below with regard to FIGS. 2A-2D, relative to the base unit 125 actually causes the elastic apparatus 130 rubber band to be hooked. Note, however, that any particular placement of the hole 120 and/or shaft 107 relative to the base unit 125 and/or handle 110, respectively, are used herein for illustrative purposes only and are not meant to limit or otherwise narrow the scope of the present invention unless explicitly claimed.

Regardless of the shapes, sizes, and/or offsets or positions of the handle, shaft 105, opposite or insertion end, 115, and/or hole 120, the handle end 110 should be formed (e.g., the pyramid shape shown in FIG. 1) such that when a user's fingers apply pressure on opposing or substantially opposing sides of the handle 110, the handle 110 slips from the fingers forcing the rod 105 into the hole 120 of the base unit 125. Note, however, that the present invention is not limited to any specific shape for the handle 110. For example, rather than the pyramid shape shown in FIG. 1, the handle end 110 of the rod 105 may be in the form of many shapes such as spherical, conical (e.g., circular cone, frustum circular cone, general cone, etc.), wedge shaped, substantially square, cylindrical, etc. It should be noted, however, for best results the handle should be formed such that (as described in greater detail below) the rod easily slips from the fingers of a user when pressure is applied to opposing ends of the handle.

Figure 2A:
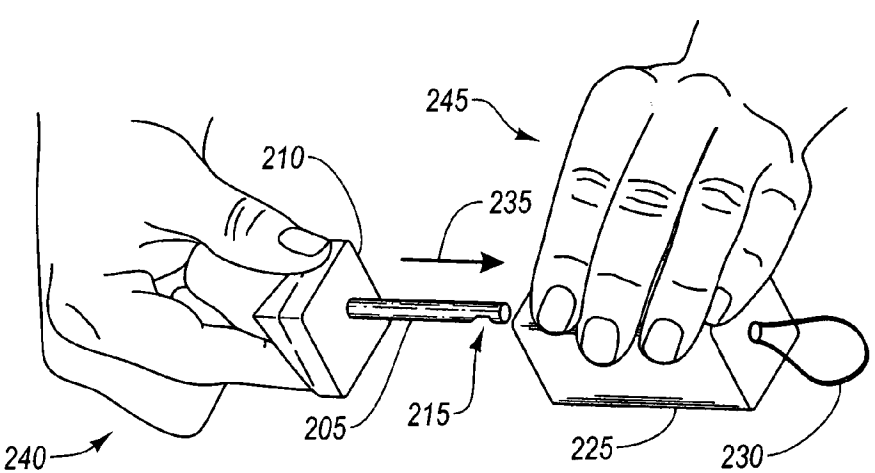
FIGS. 2A-2D illustrate a method of using the illusory snap puzzle or device in accordance with exemplary embodiments of the present invention.

FIGS. 2A-2D illustrate a method of giving the illusion that an elastic apparatus is hooked using a rod inserted into a base unit as described above. As shown in FIG. 2A, the base unit 225 is retangular in shape and has a hole (not shown) that extends substantially parallel to its length within the base unit 225. An elastic apparatus (for example, a rubber band) has the appearance of extending within the hole of the base unit 225 (or may actually extend within the hole of the base unit 225 as previously described). The left (or right) hand of a user 225 firmly grips the base unit 225. The rod 205 has an opposite or insertion end 215 and a handle end 210. In this example, the handle end is the shape of a pyramid for ease in slipping from the fingers, as described below. A user's right (or left) hand 240 grips the handle end 210 using at least two fingers (shown here as the index and thumb fingers) the user then inserts the rod 205 into the base unit as shown by arrow 235.

Once the user has inserted the rod 205 at least partway into the hole of the base unit 225, the user may then make motions with the hands such as a rotation and/or slight up and down movement of the rod 205 or handle end 210 relative to the base unit 225. This has the added effect of giving the illusion that some manipulation of the rod 205 can be performed to actually hook the elastic apparatus 230. As previously mentioned, this feature may be enhanced when the hole in the base unit 225 and the shaft of the rod 205 are slightly off center of the base unit 225 and handle end 210, respectively.

Figure 2B:
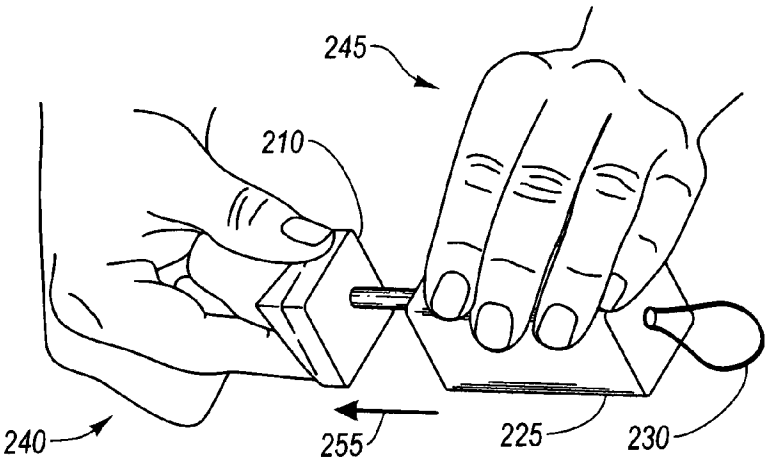
Figure 2C:
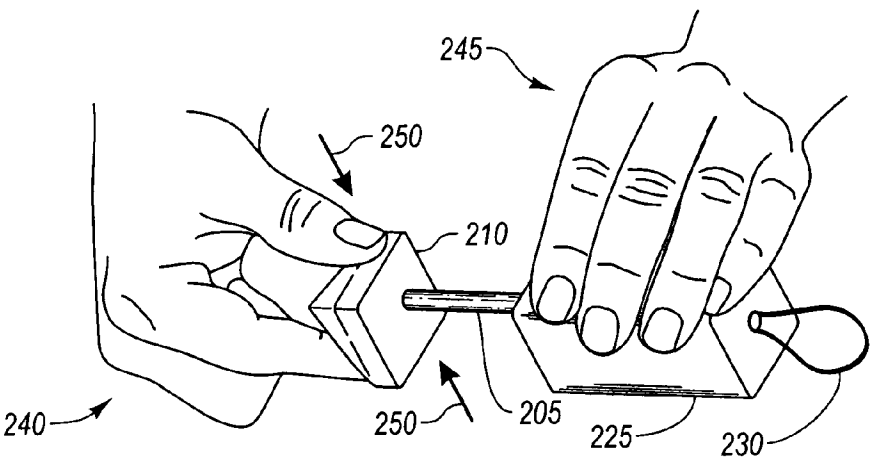
Figure 2D:
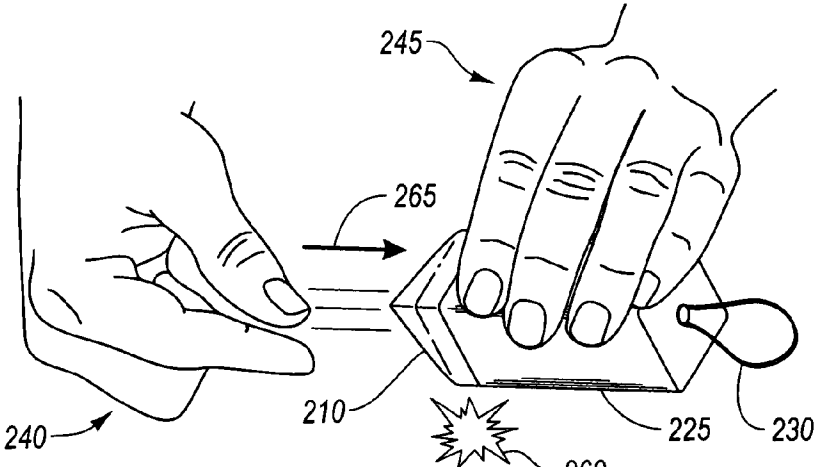

Regardless of whether the above manipulation operation is performed, after inserting the rod 235 at least partway into the base unit 225 using the handle end 210, the user then begins to extract the rod 205 from the base unit 255 as shown by arrow 255 in FIG. 2B. For optimum illusory results, this extraction motion 255 should slow down the further the rod is extracted from the base unit 225. Before the opposite or insertion end 215 can be visibly seen, the user then applies pressure, as shown in FIG. 2C, on opposing ends or substantially opposing ends of the handle end 210 of the rod 205, as indicated by the arrows 250. The force of the pressure should be sufficient such that, as shown in FIG. 2D, the handle end 210 slips from the fingers forcing the rod into the base unit 225—as indicated by arrow 265—snapping 260 the handle end 210 against the base unit 225. Accordingly, this gives the illusion as if it was the elastic apparatus 230 was hooked to the opposite or insertion end 215 of the rod and the opposing force of the elastic apparatus 230 caused the handle end 110 of the rod 205 to slip from the user's fingers 240 and force the rod 205 into the base unit 225.

Figure 3:
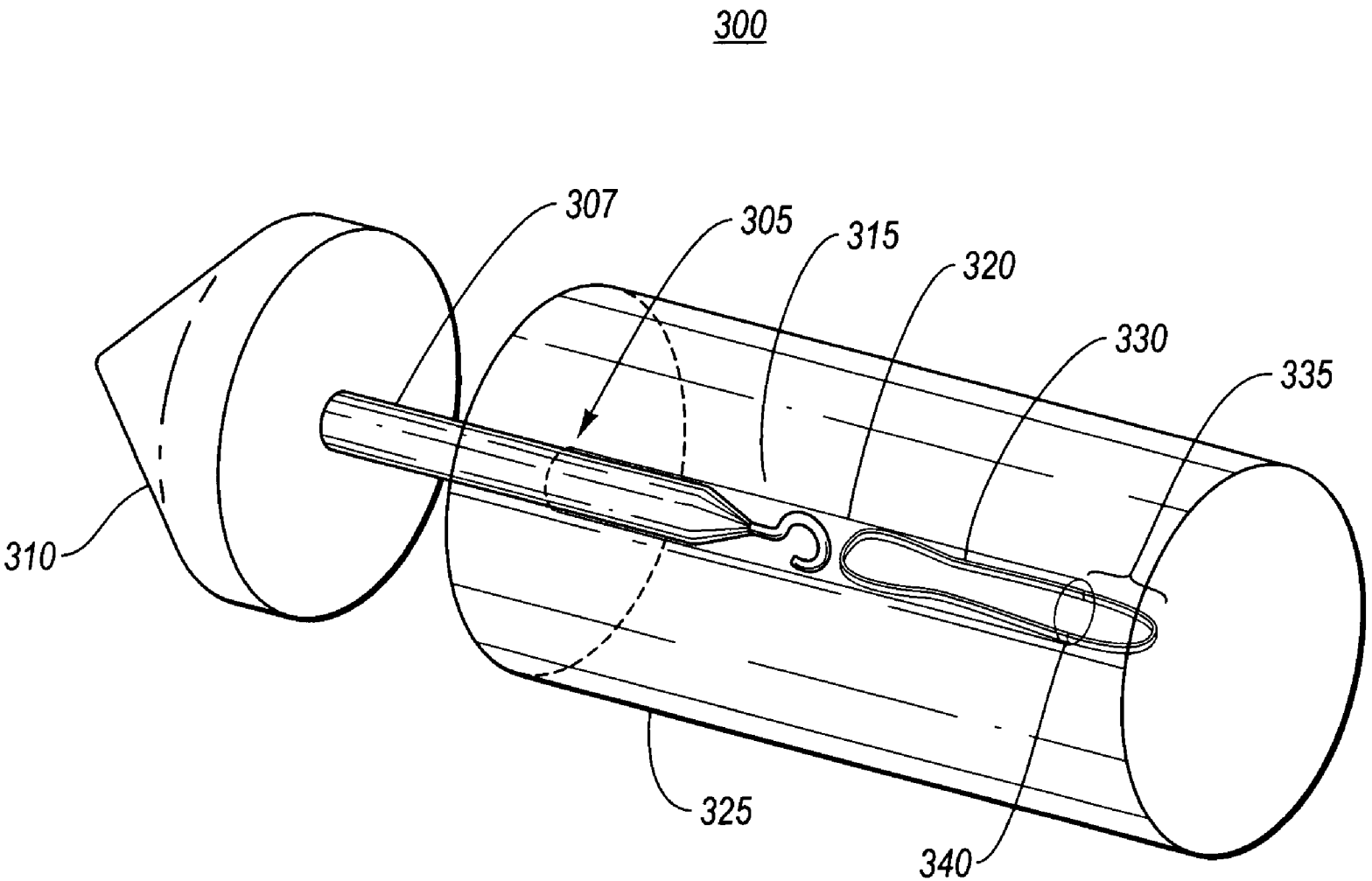
FIG. 3 illustrates another example illusory snap puzzle or device in accordance with exemplary embodiments of the present invention.

FIG. 3 illustrates an alternative embodiment wherein at least the base unit 325 of illusory snap device 300 is made from a translucent or partially transparent material such as glass, plastic, or other similar transparent or partially transparent material. In this embodiment, the elastic apparatus 330 does not necessarily need to extend beyond the end of the base unit 325. Instead, because the elastic apparatus 330 can clearly or partially be seen within the hole 320 of the base unit 325, it is not necessary for the end thereof to extend beyond the base unit 325. It may be important, however, to give the appearance that the elastic apparatus 330 is securely fastened within the base unit 325. For example, a portion 335 of the elastic apparatus 330 may be formed beyond the base 340 of the hole 320, such that the end 335 of the elastic apparatus 330 is formed and secured by the base unit 325.

Of course, other means for securing the elastic unit within the transparent base unit are also available to the present invention. For example, the hole 320 may be extended all the way through the base unit 325, as was shown with regards to FIG. 1. In such instance, a plug or other device may be used to secure the rubber band to the base unit 325, and a portion of the elastic apparatus 330 may extend beyond the base unit 325. Accordingly, any method or means for giving the appearance that elastic apparatus 330 is secured to the base unit 325 is used herein for illustrative purposes only and is not meant to limit or otherwise narrow the scope of the present invention unless explicitly claimed.

In this embodiment, as in other embodiments, the handle end 310, shaft 307, and/or opposite or insertion end 315 of the rod 305 may or may not be made of a similar transparent or semi translucent material as the base unit 325. It should be noted, however, that when such transparent or semi translucent base unit 325 is used, that in order for the illusion to appropriately be applied, the user should take special care in covering that portion of the base unit 325 that the rod 305 is inserted into during the above illusion performance. For example, the user may use her/his hand to cover up that portion of the base unit 325 that the opposite or insertion end 315 is inserted into. Alternatively, the user may cover the base unit 325 with a nontransparent sleeve (not shown) or other device to cover the view of the opposite or insertion end 315 such that one cannot see that the elastic apparatus 330 is not actually hooked by the rod 305 as previously described.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. Using an elongated base unit with a hole therein running substantially parallel to its length, an elastic apparatus extending at least partway within the hole, and a rod with a handle end and an opposite end, a method of creating the illusion as if the rod has hooked the elastic apparatus from within the hole of the base unit, wherein actually hooking the elastic apparatus within the hole of the base unit is virtually impossible, the method comprising:

inserting the opposite end of the rod at least partway into the hole of the base unit using the handle end of the rod, the base unit giving the appearance that the elastic device is attached to and extending within the hole thereof;

after inserting, rotating the handle end in relation to the base unit, wherein the hole of the base unit is substantially positioned off center from a width of the base unit such that the rotational movement causes the handle end to appear as though the rotational movement allows for a hooking of the elastic apparatus within the hole of the base unit;

after the rotational movement, pulling the inserted opposite end of the rod partially out of the base unit using the handle end of the rod; and before the opposite end of the rod is exposed in viewable sight, pressing together at least two of a user's fingers on substantially opposing sides of the handle end of the rod in order to forcibly snap the rod back into the base unit giving the illusion that the rod slipped from the user's fingers due to an opposing force from the elastic apparatus pulling on the opposite end of the rod from within the base unit.

2. The method of claim 1, wherein the base unit and rod are made of one or more materials chosen from the list of wood, metal, plastic, ceramic, fiberglass, glass, or stone.

3. The method of claim 1, wherein the opposite end of the rod inserted into the hole of the base unit is shaped in a hook form.

4. The method of claim 1, wherein the elastic apparatus extends beyond an opposite end of the base unit from where the rod is inserted.

5. The method of claim 1, wherein the base unit is clear, and the elastic apparatus can be visibly seen within the hole of the base unit.

6. The method of claim 1, wherein the elastic apparatus is a rubber band.

7. The method of claim 1, wherein the form of the handle end of the rod is chosen from one or more of a substantially spherical shape, a substantially conical shape, a substantially pyramid shape, a substantially wedge shape, a substantially square shape, or a substantially cylindrical shape.

8. A device for use in creating the illusion as if a rod has hooked an elastic apparatus from within a hole of a base unit, wherein actually hooking the elastic apparatus within the hole of the base unit is virtually impossible, the device comprising:

an elongated base unit with a hole therein running substantially parallel to its length;

an elastic apparatus having the appearance that it extends at least partway into the hole of the base unit and is attached thereto; and a rod with a handle end and an opposite end, wherein the handle end is used to insert the opposite end at least partway into the hole of the base unit and the hole of the base unit is substantially positioned off center from a width of the base unit such that a rotational movement of the handle end relative to the base unit when inserted therein appears as to cause a hooking of the elastic apparatus by the opposite end within the hole of the base unit, and wherein the handle end of the base unit is formed such that after a user inserts the rod in the base unit, provides the rotational movement, and then begins to partially extract the rod from the hole, the user's fingers apply pressure on substantially opposite ends of the handle causing the rod to slip from the user's fingers and forcibly snap into the base unit giving the illusion that the rod slipped from the user's fingers due to an opposing force from the elastic apparatus pulling on the opposite end of the rod from within the base unit.

9. The device of claim 8, wherein the base unit and rod are made of one or more materials chosen from the list of wood, metal, plastic, ceramic, fiberglass, glass, or stone.

10. The device of claim 8, wherein the opposite end of the rod inserted into the hole of the base unit is shaped in a hook form.

11. The device of claim 8, wherein the elastic apparatus extends beyond an opposite end of the base unit from where the rod is inserted.

12. The device of claim 8, wherein the base unit is clear, and the elastic apparatus can be visibly seen within the hole of the base unit.

13. The device of claim 8, wherein the elastic apparatus is a rubber band.

14. The device of claim 8, wherein the form of the handle end of the rod is chosen from one or more of a substantially spherical shape, a substantially conical shape, a substantially pyramid shape, a substantially wedge shape, a substantially square shape, or a substantially cylindrical shape.

15. A device for use in creating the illusion as if a rod has hooked an elastic apparatus from within a hole of a base unit, wherein actually hooking the elastic apparatus within the hole of the base unit is virtually impossible, the device comprising:

an elongated base unit with a hole therein running substantially parallel to its length, the elongated base unit being clear in nature;

an elastic apparatus having the appearance that it extends at least partway into the hole of the base unit and is attached thereto, such that the elastic apparatus can be visibly seen within the elongated base unit based on the clear nature; and a rod with a handle end and an opposite end shaped in a hook like form, wherein the handle end is used to insert the opposite end at least partway into the hole of the base unit, and the hole of the base unit is substantially positioned off center from a width of the base unit such that a rotational movement of the handle end relative to the base unit when inserted therein appears as to cause a hooking of the elastic apparatus by the opposite end within the hole of the base unit, and wherein the handle end of the base unit is formed such that after a user inserts the rod in the base unit, provides the rotational movement, and then begins to partially extract the rod from the hole, the user's fingers can apply pressure on substantially opposite ends thereof causing the rod to slip from the user's fingers and forcibly snap into the base unit giving the illusion that the rod slipped from the user's fingers due to an opposing force from the elastic apparatus pulling on the opposite end of the rod from within the base unit.

16. The device of claim 15, wherein the base unit is made of one or more materials chosen from plastic, ceramic, or glass.

17. The device of claim 16, wherein the opposite end of the rod inserted into the hole of the base unit is shaped in a hook form.

18. The device of claim 17, wherein the elastic apparatus extends beyond an opposite end of the base unit from where the rod is inserted.

* * * * *

UNITED STATES PATENT AND TRADEMARK OFFICE

CERTIFICATE OF CORRECTION

PATENT NO. : 7,377,855 B2
APPLICATION NO. : 11/170889
DATED : May 27, 2008
INVENTOR(S) : Leroy Q. Pia It is certified that error appears in the above-identified patent and that said Letters Patent is hereby corrected as shown below:

Column 2
Line 64, change "on" to --one--

Column 3
Line 11, change "extending" to --extend--
Line 15, change "for nontransparent materials cannot" to --is made of nontransparent materials and cannot--

Column 4
Line 56, change "elastic apparatus" to --elastic apparatus 130--
Line 60, change "225" to --245--

Column 5
Line 13, change "235" to --205--
Line 15, change "255" to --225--
Line 30, change "110" to --210--

Column 8
Line 39, in Claim 17 change "16" to --15--
Line 42, in Claim 18 change "17" to --15--

Signed and Sealed this

Twenty-third Day of June, 2009

JOHN DOLL
*Acting Director of the United States Patent and Trademark Office*